US006446526B2

(12) United States Patent
Reimann et al.

(10) Patent No.: US 6,446,526 B2
(45) Date of Patent: Sep. 10, 2002

(54) PEDAL

(75) Inventors: Christian Reimann, Wehrheim; Peter Kohlen, Butzbach-Fauerbach, both of (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/949,569

(22) Filed: Sep. 7, 2001

Related U.S. Application Data

(62) Division of application No. 09/710,577, filed on Nov. 9, 2000, now Pat. No. 6,336,377, which is a division of application No. 09/212,910, filed on Dec. 16, 1998, now Pat. No. 6,250,176.

(30) Foreign Application Priority Data

Dec. 17, 1997 (DE) ..... 197 55 980

(51) Int. Cl.[7] ..... G05G 1/14
(52) U.S. Cl. ..... 74/512; 74/513; 74/560
(58) Field of Search ..... 74/512–517, 560; 188/74, 166, 379, 380; 192/41 R

(56) References Cited

U.S. PATENT DOCUMENTS

| | | | | | |
|---|---|---|---|---|---|
| 3,052,421 | A | * | 9/1962 | Fischer | 242/55.12 |
| 4,664,232 | A | * | 5/1987 | Takagi et al. | 188/74 |
| 5,819,593 | A | * | 10/1998 | Rixon et al. | 74/514 |
| 6,109,133 | A | * | 8/2000 | Kohlen | 74/512 |
| 6,311,578 | B1 | * | 11/2001 | Kohlen | 74/513 |

FOREIGN PATENT DOCUMENTS

| | | | | |
|---|---|---|---|---|
| DE | 8915641 | | 1/1991 | |
| DE | 4321517 | | 1/1995 | |
| DE | 4426549 | | 2/1996 | |
| DE | 19517172 | A1 * | 11/1996 | 74/512 |
| DE | 29700862 | | 4/1997 | |

* cited by examiner

*Primary Examiner*—Vinh T. Luong
(74) *Attorney, Agent, or Firm*—Martin A. Farber

(57) ABSTRACT

A pedal having a pivotably mounted pedal arm, which is prestressed into an initial position by means of a restoring-spring element designed as a leg spring, has a friction body which is prestressed against a friction surface by the restoring-spring element. The friction body is designed as an eccentric cam plate and thus, in addition to a hysteresis, also permits a non-linear profile of the pedal-actuating force.

8 Claims, 3 Drawing Sheets

PEDAL

RELATED APPLICATION

Figure 1:
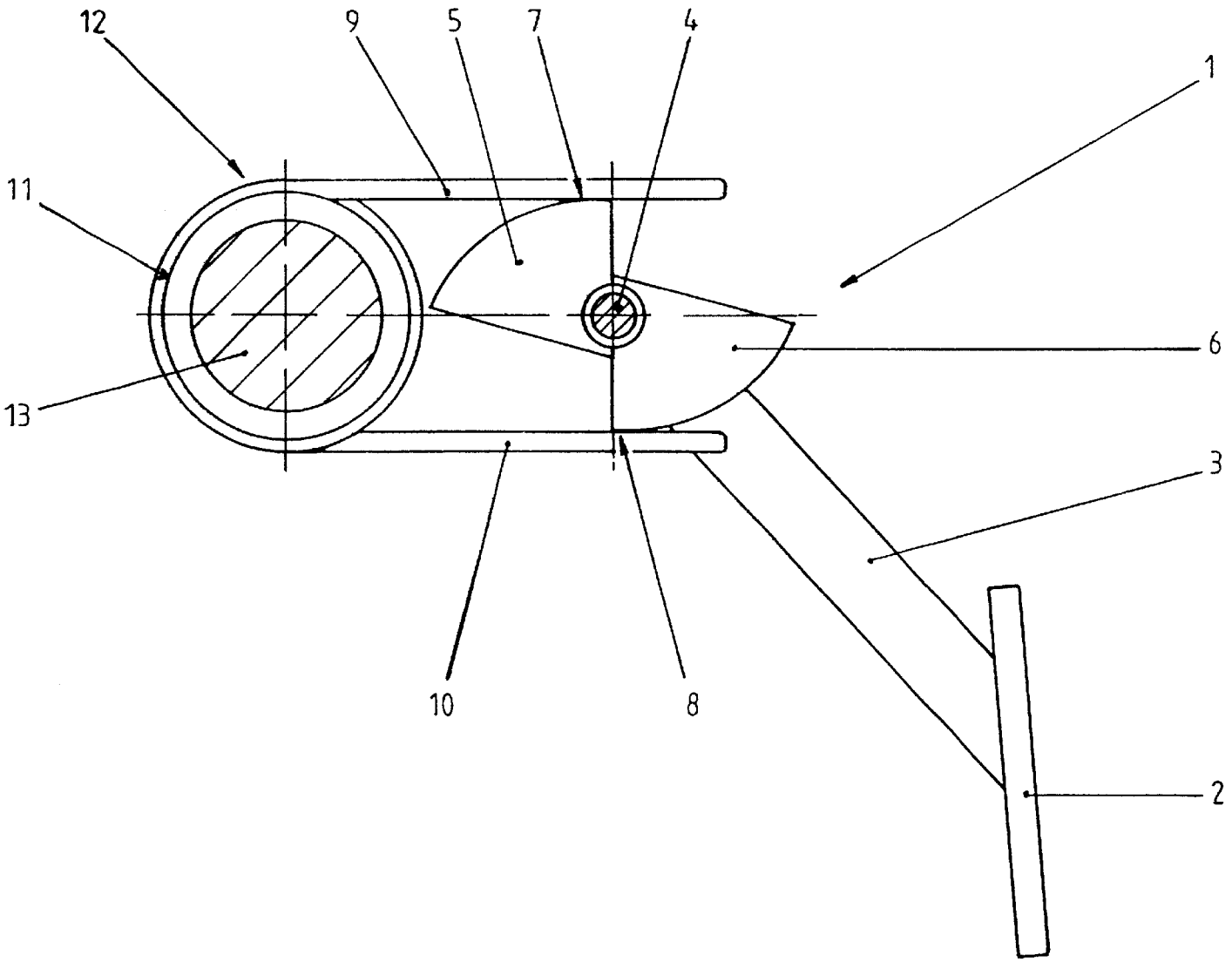

This application is a division of our application Ser. No. 09/710,577 filed Nov. 9, 2000, now U.S. Pat. No. 6,336,377 issued on Jan. 8, 2002, which in turn is a divisional application of our application Ser. No. 09/212,910 filed Dec. 16, 1998 (now U.S. Pat. No. 6,250,176 which issued Jun. 26, 2001, the contents of which are incorporated by reference herein in its entirety.

FIELD AND BACKGROUND OF THE INVENTION

The invention relates to a pedal, in particular for a vehicle, having a pedal arm which is mounted in a retaining part such that it can be pivoted about a pivot axis and which can be deflected, by means of a pedal plate, by way of foot force and can be pivoted back into an initial position by at least one restoring-spring element, and having a friction damper which comprises a friction body and a friction surface and is intended for damping the movement of the pedal arm, the friction body being connected to the pedal arm and being prestressed against the friction surface by means of the restoring-spring element.

Such pedals are commonly used nowadays as gas pedals in motor vehicles and are thus known. Upon actuation of the pedal arm, the friction body slides over the friction surface and thus prevents slight changes in the foot force on the pedal arm, for example caused unintentionally by reactions of the vehicle movement, from resulting in a change in the pedal position. In this case, the friction produced in the friction damper is usually greater in the actuating direction of the pedal arm than in the opposite direction. As a result, the friction damper has a hysteresis which ensures that the pedal arm pivots reliably back into an initial position.

The pedal arm bears at least one friction body, which is in the form of a segment of a circle and rests against a friction surface arranged at one free end of a two-armed lever. At the same time, the pedal arm is connected to the other end of the lever by means of a compression spring. This means that the contact-pressure force between the friction body and friction surface increases as the deflection of the pedal arm increases, with the result that the damping is enhanced. As a result of the abovedescribed design, the pedal requires a larger number of components which, for production and fitting, involve high outlay, the amount of space required by the arrangement, at the same time, being relatively large.

The object of the invention is to configure a pedal of the type mentioned in the introduction such that it is of as straightforward a construction as possible and, at the same time, requires just a small amount of space.

This problem is solved according to the invention in that the friction body is arranged eccentrically with respect to the pivot axis. As a result, the increase in friction, in the event of a large deflection about the pivot axis, is determined not by the restoring-spring element but, in particular, by the eccentricity of the friction body. The friction body, in this case, permits virtually any desired shaping and, associated therewith, any desired movement characteristics of the pedal arm. At the same time, it is also possible, by way of the shaping of the friction body, for the restoring force, counter to the pedal movement, to be such that adaptation to a desired characteristic curve is possible without any special restoring-spring element being necessary for this purpose.

The invention also permits the use a of conventional restoring-spring element. The pedal is designed in a particularly compact manner, according to the present invention, if the restoring-spring element is designed as a leg spring or leaf spring. This advantageously dispenses with the otherwise necessary lever, with the result that the friction body is positioned directly against the restoring-spring element.

A particularly advantageous development of the invention is one in which the friction body is designed as a cam plate. As a result, the pedal-actuating force which is to be applied by the user can be adapted optimally to desired characteristics. In particular, it is possible to combine in stepless fashion regions of the deflection action of the pedal arm with a greatly increased resistance and regions with a low resistance. For example, it is possible to represent progressive regions, in which the output limits of the drive are indicated to the driver as a greatly increased resistance.

A further advantageous embodiment of the invention is achieved if the friction body is designed with point symmetry and is clamped in between the legs of a leg spring. As a result, the spring forces applied on the friction body by the two legs of the leg spring in each case are approximately of the same magnitude and act in more or less mutually opposite directions. Only very small forces thus act on the mount of the leg spring, as a result of which the pedal can be of particularly straightforward design.

The invention is of particularly cost-effective design if, on its side which is directed toward the friction body, the restoring-spring element is designed as a friction surface. This dispenses with the laborious operation of providing a separate friction surface on the elastic restoring-spring element. At the same time, one operation in the fitting process is done away with, this rendering said design particularly cost-effective.

A particularly straightforward development of the invention is achieved if the friction body is an eccentric cam. The design merely requires extremely low production outlay and facilitates adaptation of conventional pedals in accordance with the present invention. At the same time, particularly space-saving configurations are possible with this embodiment.

A further advantageous embodiment of the invention is achieved if the restoring-spring element has a progressive spring characteristic. This further assists the function of the eccentric arrangement of the friction body. At the same time, particularly finely tuned and precise coordination with predetermined movement characteristics can be achieved.

Figure 2:
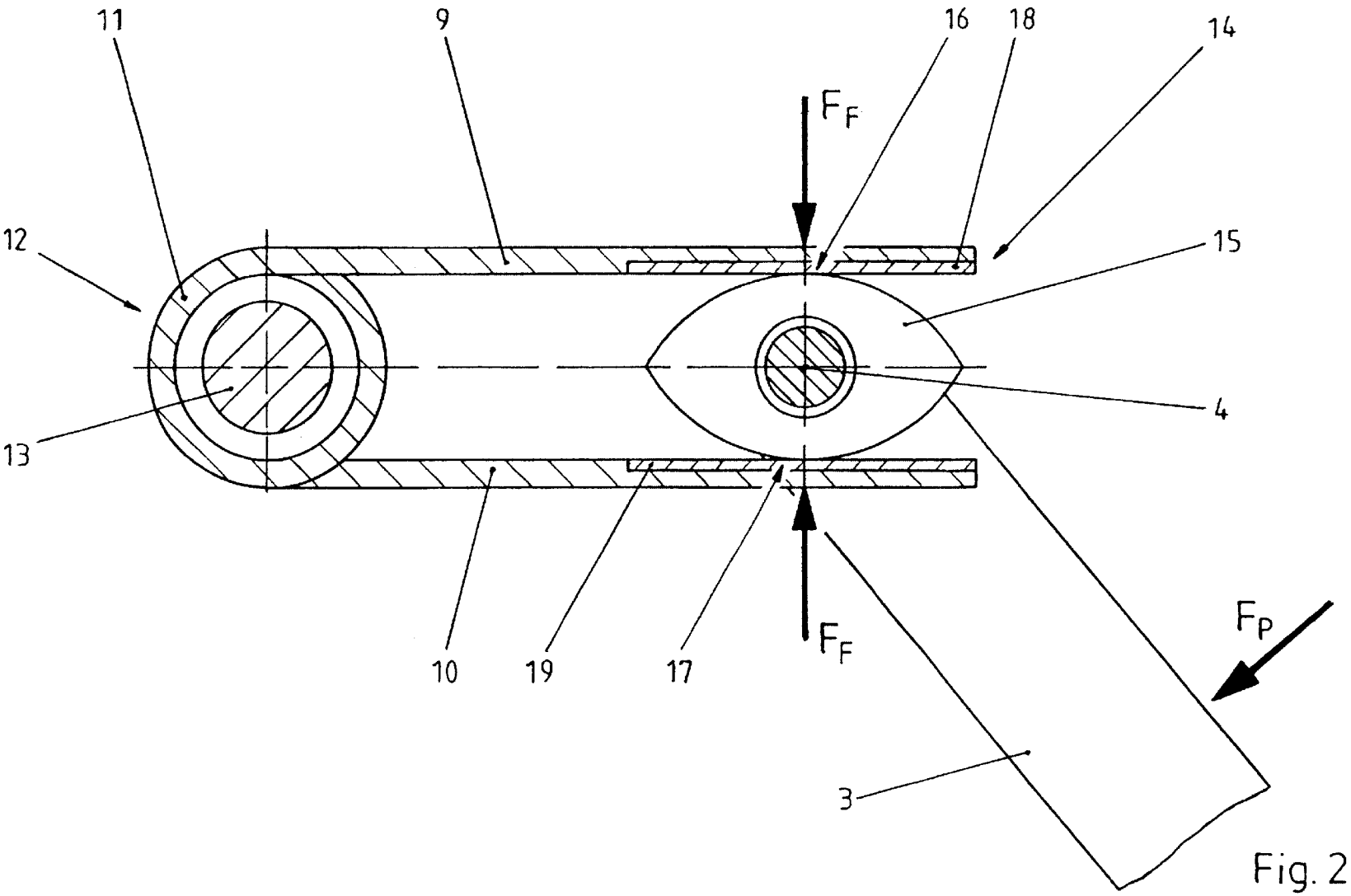
Figure 3:
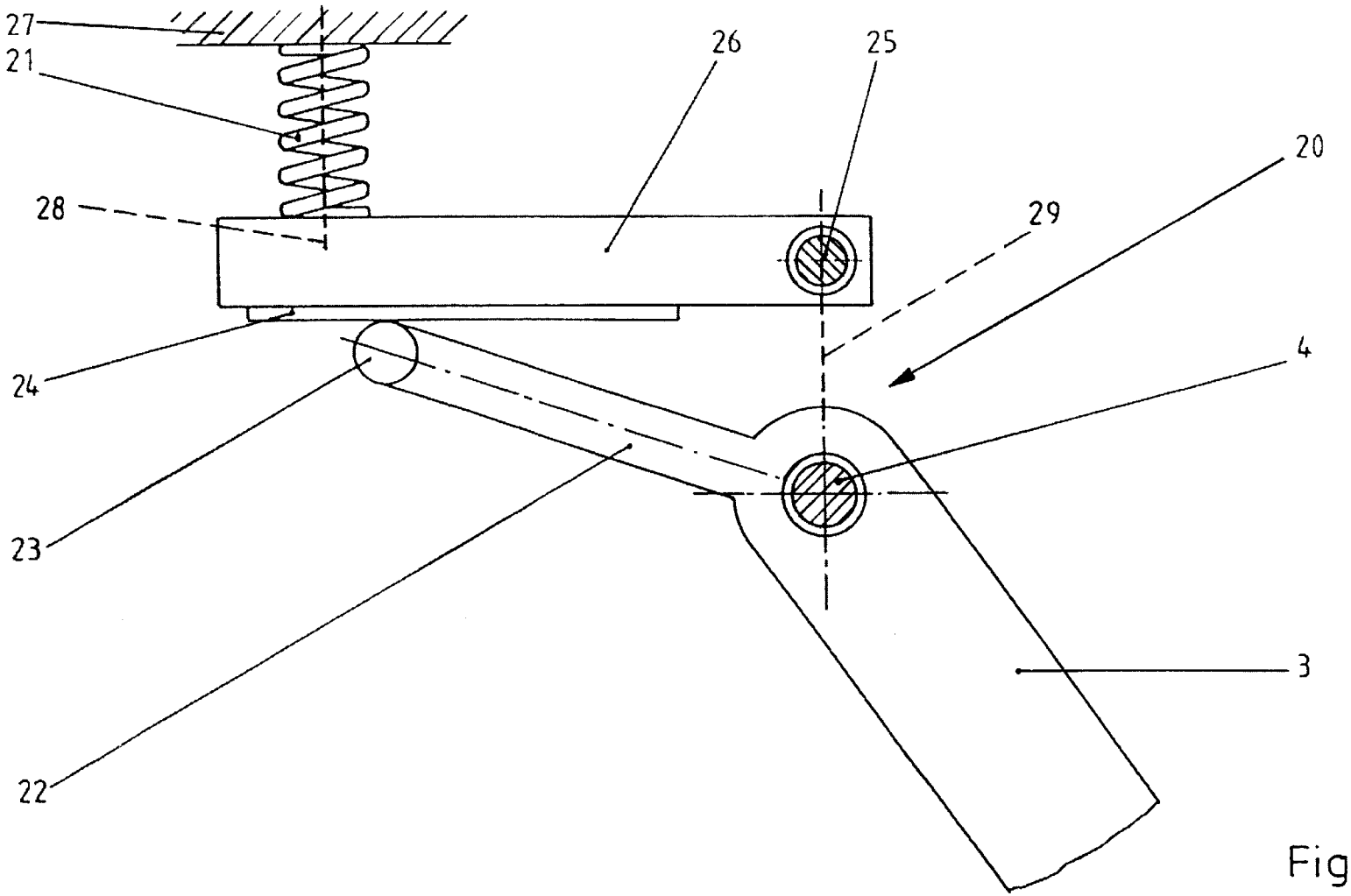

The invention permits numerous embodiment. In order further to illustrate the basic principle of the invention, three of these embodiments are described hereinbelow and illustrated in the drawing, in which:

FIG. 1 shows a schematic illustration of a pedal according the invention with two friction bodies, FIG. 2 shows a schematic illustration of a pedal according to the invention with just one friction body, and FIG. 3 shows a schematic illustration of a further pedal according to the invention.

DETAILED DESCRIPTION OF THE PREFERRED EMBODIMENTS

FIG. 1 illustrates a side view, partly in section, of a pedal 1 according to the invention. This figure shows a pedal arm 3 which has a pedal plate 2, is mounted such that it can be pivoted about a pivot axis 4 and is connected to two friction bodies 5 and 6, which are designed as cams. The friction bodies 5 and 6 each have a surface section 7, 8 which rests against a leg 9, 10 of a restoring-spring element 12, which is designed as a leg spring 11. The leg spring 11 comprises a spindle 13, which serves for fixing the leg spring 11. Upon actuation of the pedal arm 3 by means of the pedal plate 2, the friction bodies 5 and 6 spread the two legs 9 and 10 apart counter to the resistance of the leg spring 11. The profile of the characteristic curve of the pedal-actuating force is determined here essentially by the contours of the surface sections 7 and 8 of the friction bodies 5 and 6. This makes it possible to achieve, in a straightforward manner, linear profiles, as well as progressive and degressive profiles, of the characteristic curve of the pedal-actuating force. Furthermore, the friction damping is greater when the pedal arm 3 is pushed down than when it is released, this achieving a hysteresis. The hysteresis means that relatively small, possible undesired changes in the foot force exerted on the pedal plate 2 do not result in the pedal arm pivoting and thus no actuation movement.

FIG. 2 shows a pedal 14, which is modified slightly with respect to the pedal 1, which is illustrated in FIG. 1. In this case, the pedal arm 3, just part of which is illustrated, is connected to a single-part friction body 15. The surfaces 16, 17 of the friction body 15, said surfaces being directed toward the two legs 9, 10 of the leg spring 11, each rest against a section of the legs 9, 10 which is designed as a friction surface 18, 19. To aid understanding, the pedal-actuating force $F_P$, which is applied on the pedal arm 3 by the user, and the spring force $F_F$, which is applied on the friction body 15 by the two legs 9, 10 of the leg spring 11 in each case, are depicted schematically in this figure. In the case of this embodiment of the invention, it is advantageous, in particular, for the lines of action of the spring force $F_F$, applied by the two legs 9, 10 in each case, to be approximately aligned. The leverage determined in each case by the distance between the spindle 13 and the contact surface between the respective leg 9, 10 and the friction body 15 remains unchanged even in the event of different deflections of the pedal arm 3 about the pivot axis 4. Only very small forces thus act on the spindle 13. At the same time, it is easy to define the necessary pedal-actuating force $F_P$ in dependence on the deflection of the pedal arm 3.

FIG. 3 shows a further design of a pedal 20, which has a conventional restoring-spring element 21 designed as a compression spring. In this embodiment, the pedal arm 3, which can be pivoted about the pivot axis 4 and just part of which is illustrated, has a lever arm 22, at the free end of which a friction body 23 is arranged. This friction body 23 rests against a friction surface 24 of a lever 26, which can be pivoted about a spindle 25. Arranged at the free end of the lever 26, said free end being located opposite the spindle 25, is the restoring-spring element 21, which is designed as a compression spring and presses the friction surface 24, which is arranged on the lever 26, against the friction body 23. That end of the spring element 21 which is directed away from the lever 26 is supported on a wall 27 of a pedal housing (not illustrated any more specifically). Upon actuation of the pedal arm 3, the friction body 23 moves with friction along the friction surface 24 in the direction of the spindle 25 of the lever 26, the leverage, and thus the force counteracting any further deflection, changing in the process. This results in a pedal-actuating force which increases as the deflection of the pedal arm 3 increases, an essentially progressive profile being achieved as a result. In addition, the restoring-spring element 21 itself may have any desired, in particular progressive, spring characteristic or means for presetting the spring force.

The restoring spring element 21 has an axis 28 substantially parallel to an imaginary line 29 joining a pivot at the spindle 25 to the pivot axis 4.

What is claimed is:

1. A pedal, suitable for a vehicle, comprising:

a pedal arm, a pedal plate mounted to the pedal arm, a restoring-spring element, and a friction damper including a friction body and a friction surface;

wherein the pedal arm is pivotable about a pivot axis and is deflectable by the pedal plate, by foot force, and is pivotable back into an initial position by the restoring-spring element;

the friction damper is for damping movement of the pedal arm, the friction body being connected to a lever arm of the pedal arm and being prestressed against the friction surface by the restoring-spring element; wherein the friction body is arranged eccentrically with respect to the pivot axis; and the pedal further comprises a second lever pivotably mounted at one end and having said friction surface on one side, wherein said restoring-spring element is a compression spring which engages said second lever on an other side of the second lever spaced from said one end, and presses said friction surface against said friction body.

2. The pedal as claimed in claim 1, wherein the friction body comprises an eccentric cam.

3. The pedal as claimed in claim 1, wherein the restoring-spring element has a progressive spring characteristic.

4. The pedal as claimed in claim 1, wherein the second lever and the pedal respectively are pivotal about spaced apart pivot points.

5. The pedal as claimed in claim 1, wherein said restoring-spring element has an axis parallel to an imaginary line joining said pivot points.

6. A pedal, suitable for a vehicle, comprising:

a pedal arm, a pedal plate mounted to the pedal arm, a restoring-spring element, and a friction damper including a friction body and a friction surface;

wherein the pedal arm is pivotable about a pivot axis and is deflectable by the pedal plate, by foot force, and is pivotable back into an initial position by the restoring-spring element;

the friction damper is for damping movement of the pedal arm, the friction body being connected to a lever arm of the pedal arm and being prestressed against the friction surface by the restoring-spring element; wherein the friction body is arranged eccentrically with respect to the pivot axis; and the pedal further comprises a second lever pivotably mounted at one end and having said friction surface on one side, wherein said restoring-spring element is a compression spring which engages a free end of said second lever on an other side of the second lever, and presses said friction surface against said friction body; and wherein said friction surface is on the free end of said second lever.

7. The pedal as claimed in claim 6, wherein the second lever and the pedal respectively are pivotal about spaced apart pivot points.

8. The pedal as claimed in claim 6, wherein said restoring-spring element has an axis parallel to an imaginary line joining said pivot points.

* * * * *